US009909378B2

(12) United States Patent
Myhre et al.

(10) Patent No.: US 9,909,378 B2
(45) Date of Patent: Mar. 6, 2018

(54) METHOD FOR DOWNHOLE CUTTING OF AT LEAST ONE LINE DISPOSED OUTSIDE AND ALONG A PIPE STRING IN A WELL, AND WITHOUT SIMULTANEOUSLY SEVERING THE PIPE STRING

(71) Applicant: Well Technology AS, Tananger (NO)

(72) Inventors: Morten Myhre, Tanganger (NO); Arne Gunnar Larsen, Sandnes (NO); Roy Inge Jensen, Stavanger (NO); Patrick Andersen, Hafrsfjord (NO); Erlend Engelsgjerd, Tananger (NO); Markus Iuell, Tananger (NO); Arnold Ostvold, Stavanger (NO); Arnt Olav Dahl, Randaberg (NO)

(73) Assignee: Hydra Systems AS, Tanager ( * ) Notice: Subject to any disclaimer, the term of this patent is extended or adjusted under 35 U.S.C. 154(b) by 332 days.

(21) Appl. No.: 14/760,863

(22) PCT Filed: Feb. 5, 2014

(86) PCT No.: PCT/NO2014/050020
§ 371 (c)(1),
(2) Date: Jul. 14, 2015

(87) PCT Pub. No.: WO2014/126478
PCT Pub. Date: Aug. 21, 2014

(65) Prior Publication Data

US 2016/0010415 A1 Jan. 14, 2016

(30) Foreign Application Priority Data

Feb. 13, 2013 (NO) ..... 20130241

(51) Int. Cl.
*E21B 29/04* (2006.01)
*E21B 33/13* (2006.01)

(52) U.S. Cl.
CPC ..... *E21B 29/04* (2013.01); *E21B 33/13* (2013.01)

(58) Field of Classification Search
CPC .... E21B 29/002; E21B 29/005; E21B 29/007; E21B 29/02; E21B 29/04; E21B 33/13
(Continued)

(56) References Cited

U.S. PATENT DOCUMENTS 4,531,583 A 7/1985 Revett
4,889,187 A 12/1989 Terrell et al.
(Continued)

FOREIGN PATENT DOCUMENTS

GB 258808 9/1926
GB 2484166 A 4/2012
(Continued)

OTHER PUBLICATIONS

International Search Report and Written Opinion for PCT/NO2014/050020 dated May 9, 2014.

*Primary Examiner* — Michael R Wills, III
(74) *Attorney, Agent, or Firm* — Andrus Intellectual Property Law, LLP

(57) ABSTRACT

A method is for cutting of at least one line disposed along a pipe string in a well. The method includes (A), using a cutting tool for selective cutting activation and provided with at least one cut-forming means for cutting in a radial direction outward from the cutting tool; and (B) lowering the cutting tool to a longitudinal section where the cutting is to be carried out. In (A), a cutting tool is used for controlled cutting in a peripheral direction and distributed in an axial direction relative to the cutting tool. The method further includes (C), activating the cutting tool and cutting, in the radial direction through and past the wall of the pipe string, at least one peripherally extending hole collectively cover-
(Continued)

ing the entire circumference of the pipe string, and also distributing the hole in the axial direction.

31 Claims, 9 Drawing Sheets

(58) Field of Classification Search
USPC ..... 166/385
See application file for complete search history.

(56) References Cited

U.S. PATENT DOCUMENTS

| | | | | |
|---|---|---|---|---|
| 5,791,417 | A | 8/1998 | Haugen et al. | |
| 5,924,489 | A * | 7/1999 | Hatcher | E21B 17/1007 166/298 |
| 8,020,619 | B1 | 9/2011 | Robertson et al. | |
| 8,336,612 | B2 * | 12/2012 | Robertson | E21B 17/026 166/297 |
| 2005/0121232 | A1 | 1/2005 | Rudd et al. | |
| 2009/0294127 | A1 | 12/2009 | Krueger et al. | |
| 2010/0326665 | A1 * | 12/2010 | Redlinger | E21B 29/005 166/339 |
| 2012/0006547 | A1 * | 1/2012 | Robertson | E21B 17/026 166/298 |
| 2012/0186817 | A1 | 7/2012 | Gibson et al. | |
| 2014/0033885 | A1 | 2/2014 | Fuhst et al. | |
| 2014/0326470 | A1 * | 11/2014 | Tinnen | E21B 33/134 166/385 |

FOREIGN PATENT DOCUMENTS

| | | | |
|---|---|---|---|
| NO | 20111641 | A | 7/2012 |
| WO | 0125594 | A1 | 4/2001 |
| WO | 02081861 | A1 | 10/2002 |
| WO | 2012096580 | A1 | 7/2012 |

* cited by examiner

METHOD FOR DOWNHOLE CUTTING OF AT LEAST ONE LINE DISPOSED OUTSIDE AND ALONG A PIPE STRING IN A WELL, AND WITHOUT SIMULTANEOUSLY SEVERING THE PIPE STRING

CROSS-REFERENCE TO RELATED APPLICATIONS

This application is the U.S. national stage application of International Application PCT/NO2014/050020, filed Feb. 5, 2014, which international application was published on Aug. 21, 2014, as International Publication WO2014/126478 in the English language. The international application is incorporated herein by reference, in entirety. The international application claims priority to Norwegian Patent Application No. 20130241, filed Feb 13, 2013, which is incorporated herein by reference, in entirety.

FIELD OF THE INVENTION

The present invention concerns a method for downhole cutting of at least one line disposed outside and along a pipe string in a well, and without simultaneously severing the pipe string. The method is suitable, as an introductory measure, in context of temporary or permanent plugging of one or more longitudinal sections of a well.

The well may be comprised of any type of subterranean well, for example a petroleum well, injection well, exploration well, geothermal well or water well, and the well may be located onshore or offshore.

BACKGROUND OF THE INVENTION

Typically, a subterranean well is provided with several sizes of more or less concentric pipe strings extending individually and successively, and with a diminishing tubular cross section, down to increasingly larger depths in the well. Pipes in such pipe strings typically are referred to as casings, liners, production tubings, injection tubings or similar. The primary object of the pipe string is to secure the well against external forces capable of causing well failure, and to prevent undesirable and unintentional flows of fluids within the well and/or out of the well. Typically, the deepest pipe string will penetrate one or more subterranean reservoirs containing, for example, oil, gas and/or water, whereas the opposite end of the pipe string typically will extend to the surface for recovery of such reservoir fluids or, alternatively, for injection of e.g. water and/or other injection fluids.

Between such successive pipe string sizes, and possibly between a pipe string and a surrounding borehole wall, one or more annuli will exist. In such annuli, various lines may be disposed so as to extend along a pipe string, the lines of which are normally attached on the outside of the pipe string. Such lines may comprise thin pipes or hoses, for example hydraulic pipes or chemical pipes, but also electric cables, fiber-optic cables or similar, possibly also associated support cables consisting of, for example, suitable wires or threads in order to unburden various loads, including tensile forces, acting on the lines along the pipe string. Such lines and possible support cables may be distributed individually around the circumference of the pipe string, and/or they may be arranged in one or more cable assemblies. In such a cable assembly, the lines commonly are cast into a sheath made of a flexible and protective material of a suitable type and shape, for example a rubber material or a plastics material. Typically, such lines are used to transmit various signals, including control signals and various data, and also motive power and/or various fluids between the surface and equipment disposed down within a well, and typically far down in the well. For this reason, such equipment typically is connected to a production tubing string or an injection tubing string, and commonly in context of so-called smart wells. Such downhole equipment, however, may also be placed at a shallower level in a well. This equipment may comprise various measuring instruments and monitoring equipment, for example equipment for measuring and monitoring pressure and temperature in a well. Such equipment may also comprise various ports, valves, actuators, hydraulic pistons, motors, pumps, supply equipment for various chemicals, injection equipment, gas lift equipment, etc., and also potential equipment for monitoring, controlling and/or driving the aforementioned equipment. Such equipment constitutes prior art.

Upon temporary or permanent abandonment of a well, it is customary to pressure-isolate one or more annuli and pipe bores along certain longitudinal intervals in the well, and particularly in or along one or more reservoir sections of the well. Normally, such pressure-isolation is carried out by conducting cement slurry into the/those annulus/annuli and pipe bore(s) of interest in the well, after which the cement slurry is allowed to harden therein.

Upon such cementation, however, continuous lines disposed in an annulus along a pipe string may constitute leakage channels for pressurized fluids residing in the well. If such leakage channels are not sealed so as to become pressure-isolated, the pressurized fluids unintentionally may flow onto other regions of the well, and possibly out of the well, which is not desirable. For this reason, it is customary for the operator of the well, and/or for the authorities of the particular country, to require that the lines are severed and possibly removed before initiating said cementation, and in such a manner that said cement slurry may surround the severed lines and possibly penetrate into the leakage channels that may be located therein. This is considered to be an adequate measure for ensuring that also the lines are pressure-isolated in context of cementation and plugging. In Norway, such statutory requirements are detailed in the official document termed NORSOK D-010, and the requirements are known well within the petroleum industry of Norway. Similar requirements also exist in other countries.

Nevertheless, there is a need in the industry for a more cost-efficient way of severing such longitudinal lines in a well, and without significantly weakening, in terms of strength, the integrity of the well. This is the need addressed, first and foremost, by the present method.

PRIOR ART AND DISADVANTAGES THEREOF

Traditionally, cutting of such longitudinal lines is carried out by virtue of severing both the lines and the associated pipe string and pulling them out of the well. Thereafter, the or those particular longitudinal intervals of the well are cemented. Obviously, such a procedure requires several trips into the well, for example in order to cut and release one or more sections of the pipe string. Accordingly, this known procedure may prove very time-consuming and costly to perform.

OBJECTS OF THE INVENTION

The primary object of the invention is to remedy or reduce at least one disadvantage of the prior art, or at least to provide a useful alternative to the prior art.

Another object of the invention is to provide a method rendering possible, within a longitudinal section of a well, to sever one or more lines disposed outside and along a pipe string in a well, and without simultaneously severing the pipe string. By so doing, the pipe string does not need to be pulled out of the well, whereby the pipe string also maintains integrity, in terms of strength, within said longitudinal section.

Further, it is an object to use the present method for severing of said at least one line, and as an introductory measure before temporary or permanent plugging of said longitudinal section of the well. By so doing, a discontinuity is established in the at least one line, whereby a subsequent plugging material may surround and possibly penetrate into and seal/pressure-isolate said line, thereby preventing unintentional flow of well fluids through said line. It is also possible, in this manner, to plug said longitudinal section without removing all or parts of an associated pipe string, whereby the pipe string may also be used as reinforcement for a subsequent plugging material being filled within said longitudinal section.

It is also an object to provide a method rendering possible to carry out said cutting of at least one line within said longitudinal section by means of various types of cutting tools, and/or by means of various types of cutting patterns through the pipe string.

A further object is to provide a method rendering possible to sever said at least one longitudinal line within at least one further longitudinal section of the well, and preferably in one trip down into the well.

GENERAL DESCRIPTION OF HOW TO ACHIEVE THE OBJECTS

The objects are achieved by virtue of features disclosed in the following description and in the subsequent claims.

According to the invention, a method is provided for downhole cutting of at least one line disposed outside and along a pipe string in a well, and without simultaneously severing the pipe string, wherein the method comprises the following steps:

(A) using, for said cutting purpose, a cutting tool structured for selective cutting activation and provided with at least one cut-forming means configured for cutting, upon said activation, in a radial direction outward from the cutting tool; and (B) lowering, on a connection line, the cutting tool into the pipe string to a longitudinal section of the well where the cutting of the at least one line is to be carried out.

The distinctive characteristic of the method is that it uses, in step (A), a cutting tool also configured for controlled cutting, by means of said cut-forming means, in a peripheral direction and distributed in an axial direction relative to the cutting tool; and (C) activating, within said longitudinal section, the cutting tool and cutting, in the radial direction through and past the wall of the pipe string, at least one peripherally extending hole collectively covering, at least, the entire circumference of the pipe string, and also distributing the at least one peripherally extending hole in the axial direction along the pipe string, thereby ensuring that the at least one line, which is located on the outside of the pipe string, also is severed within the longitudinal section, and without simultaneously severing the pipe string.

It is desirable for the pipe string to remain as intact as possible and in the same position in the well, and for a lower portion of the pipe string not to be separated from an upper portion thereof. Such a situation is preferable to avoid, among other things, cutting, releasing and pulling the pipe string with associated lines out of the well (cf. the preceding discussion on disadvantages of the prior art).

To be able to cut one or more lines located some place on the outside of and along the circumference of the pipe string, it is important that at least one peripherally extending hole is cut through and past the wall of the pipe string, and at least along the entire circumference of the pipe string. It is emphasized that a peripherally extending hole also may have an axial component, i.e. the hole may extend obliquely, i.e. at an angle, along the circumference of the pipe string, and relative to a longitudinal axis through the pipe string. Further, such a peripherally extending hole may be discontinuous to a certain degree provided that the line(s) on the outside of the pipe string are cut sufficiently, for example upon partial severing of a fluid-carrying pipe. This may be a realistic situation if, for example, explosive charges are used for such cutting (cf. discussion on perforation tools below). However, the cutting precision in each case will be dependent on the type of cutting tool being used to carry out the cutting operation in question. In order to avoid severing the very pipe string during the cutting operation, it is also important not to form a peripherally continuous and endless hole through the wall of the pipe string. For this reason, the at least one hole must also be distributed, as viewed collectively, in the axial direction along the pipe string, i.e. In the longitudinal direction of the pipe string, and within said longitudinal section of the well. Various operational means and cutting patterns exist for achieving such a cutting result, which will be discussed in further detail below and in the subsequent exemplary embodiment.

According to a first embodiment, the method comprises using, in step (A), a cutting tool and cut-forming means comprising a perforation tool provided with at least one explosive charge configured for cutting of the at least one peripherally extending hole through and past the wall of the pipe string, and within the longitudinal section, upon activating detonation in step (C).

Perforation tools provided with cut-forming means, in the form of explosive charges, constitute prior art per se and are typically used to perforate a pipe string in a well, for example a production tubing or an injection tubing, thereby creating dedicated fluid flow paths in the well. It is customary, upon such perforation, to use so-called directional charges ("shaped charges"), which typically are assembled and distributed in accordance to a particular pattern on the perforation tool in question, the charges of which form, upon detonation, substantially circular holes through the pipe wall of the well pipe.

Such perforation tools may also be used in the present method. For the present method, it should also be possible to modify such shaped charges to be able to form, when in an operational position, more or less oblong and peripherally extending holes through and past the pipe wall. Alternatively, two or more shaped charges of an ordinary type may be used, the charges of which are assembled so as to collectively form, upon detonation, an oblong and peripherally extending hole through the pipe wall. It is customary to lower such perforation tools into the pipe string on a line, for example an electric cable, a coiled tubing string or a drill pipe string, and the charges may be detonated via electric signals or via a pressure increase. Such equipment constitutes prior art. Normally, perforation tools for perforation of a production tubing and similar do not need to be anchored and centralized in the pipe string before detonating activation.

For the present method, however, it may prove advantageous or necessary, in order to achieve sufficiently precise cutting of the at least one peripherally extending hole, to anchor and possibly centralize the perforation tool in the pipe string before carrying out said detonation in step (C). This may be advantageous or necessary due to modification of the charges of the perforation tool, and/or due to carrying out the cutting in a highly deviated well.

For this reason, the perforation tool may also comprise at least one anchoring device structured for selective activation and being activated between step (B) and step (C) so as to anchor the perforation tool in the pipe string before initiating step (C); and deactivating and releasing said anchoring device from the pipe string after step (C).

The prior art comprises several types of anchoring devices capable of being used for this purpose. As such, the at least one anchoring device of the perforation tool may comprise at least one radially expandable gripping device of a type known per se, for example a gripping dog, being activated and expanded radially outward, when required, until engagement with the wall of the pipe string, and being deactivated and released from the pipe string after step (C). The prior art also comprises a series of mechanisms and methods for activation and deactivation of such anchoring devices, the mechanisms and methods of which may also be used in the present method. Further, various known centralizer devices may be used in the present method. Such prior art, however, will not be discussed in further detail herein.

According to a second embodiment, the method comprises using, in step (A), a cutting tool and cut-forming means comprising a hydraulic cutting tool provided with at least one radially directed fluid discharge body for an abrasive fluid, wherein the at least one fluid discharge body is in hydraulic communication with a fluid source for selective supply of the abrasive fluid, and wherein said fluid discharge body is configured for cutting of the at least one peripherally extending hole through and past the wall of the pipe string, and within the longitudinal section, upon activating discharge of the abrasive fluid in step (C);

wherein the hydraulic cutting tool also comprises at least one anchoring device structured for selective activation and being activated between step (B) and step (C) so as to anchor the hydraulic cutting tool in the pipe string before initiating step (C); and deactivating and releasing said anchoring device from the pipe string after step (C).

Hydraulic cutting tools provided with one or more nozzles through which a so-called abrasive fluid may flow at high velocity, constitute prior art per se. Such cutting tools are used in a number of technical contexts, for example to carry out profiled cuts through metal plates, but also to sever casings in a well. Such hydraulic cutting tools may also be used in the present method.

The abrasive fluid may be comprised of a suitable liquid, for example water, and possibly of such a liquid admixed with a suitable abrasive agent, for example natural or synthetic particles of wear-resistant material. Further, the abrasive fluid may be supplied to the cutting tool via a line from the surface. As an alternative, the cutting tool may be provided with, or be associated with, an individual receptacle containing the abrasive fluid and being connected to a suitable pumping means for allowing the fluid to be driven onto said radially directed fluid discharge body in the cutting tool. The at least one radially directed fluid discharge body of the cutting tool may also comprise a nozzle of a suitable type.

The hydraulic cutting tool may comprise at least one anchoring device and a potential centralizer device of the same type described in context of the above-mentioned perforation tool.

Further, the at least one fluid discharge body may be structured so as to be peripherally movable relative to the hydraulic cutting tool. Thereby, said fluid discharge body is movable in the peripheral direction during the cutting. This peripheral movement may possibly comprise an axial component of direction, thereby allowing an obliquely-directed peripheral hole to be cut through the pipe string, and along the circumference thereof, as viewed relative to the longitudinal axis of the pipe string. The fluid discharge body may also be structured in a manner allowing it to be moved back and forth in the peripheral cutting direction, thereby achieving a more precise and/or gentle cutting through the pipe string and said lines on the outside thereof. Thus, the fluid discharge body may be operatively connected to a suitable driving device, for example an actuator or a motor, causing said peripheral movement of the fluid discharge body.

According to a third embodiment, the method comprises using, in step (A), a cutting tool and cut-forming means comprising a mechanical cutting tool provided with at least one radially movable cutting body, wherein the at least one cutting body is connected to a motive power source for selective supply of motive power to said cutting body, and wherein said cutting body is configured for cutting of the at least one peripherally extending hole through and past the wall of the pipe string, and within the longitudinal section, upon activating supply of motive power in step (C);

wherein the mechanical cutting tool also comprises at least one anchoring device structured for selective activation and being activated between step (B) and step (C) so as to anchor the mechanical cutting tool in the pipe string before initiating step (C); and deactivating and releasing said anchoring device from the pipe string after step (C).

Mechanical cutting tools provided with several rotatable cutting discs for cutting of pipes constitute prior art per se. It is also known to use cutting tools provided with radially movable and rotatable cutting discs for internal cutting of casings in context of abandoning wells. Such cutting discs are mounted on radially expandable arms that move and force, upon activation, the cutting discs outward and against the inside of the casing. Then, the cutting tool is rotated in the casing, whereby the cutting discs are rotated and carry out a peripherally continuous and endless cut through the wall of the casing.

A modified version of such a mechanical cutting tool, which comprises at least one radially expandable arm with an associated cutting body, may also be used in the present method. On the other hand, such a modified cutting tool cannot be allowed to carry out a peripherally continuous and endless cut through the wall of the pipe string.

Further, the present cutting body may be comprised of a rotatable cutting disc, such as described above, or of any other mechanical cutting device of a suitable shape and material. For activation and operation, the cutting body may be connected to any suitable motive power source for supply of motive power to the cutting body. For example, the motive power source may comprise suitable actuators and/or motors for activating and driving the cutting body during the cutting operation. The very motive power may be comprised of electric, hydraulic and/or mechanical energy being supplied in a suitable manner, for example from the surface and/or from a local energy source, if appropriate. Thus, the mechanical cutting device may comprise at least one rotatable cutting disc being forced, upon activation, radially outward and against the pipe string, and then being rotated until the cutting disc forms a peripherally extending hole through the pipe string. The rotation of the cutting disc may be carried out by means of a suitable rotary device, for example a rotary motor, operatively connected to the cutting disc, for example via a cog wheel connection or similar.

The mechanical cutting tool may comprise at least one anchoring device and a potential centralizer device of the same type described in context of the above-mentioned perforation tool.

The at least one cutting body may also be structured so as to be peripherally movable relative to the mechanical cutting tool. Thereby, said cutting body is movable in the peripheral direction during the cutting. This peripheral movement may possibly comprise an axial component of direction, thereby allowing an obliquely-directed peripheral hole to be cut through the pipe string, and along the circumference thereof, as viewed relative to the longitudinal axis of the pipe string. The cutting body may also be structured in a manner allowing it to be moved back and forth in the peripheral cutting direction, thereby achieving a more precise and/or gentle cutting through the pipe string and said lines on the outside thereof. Thus, the cutting body may be operatively connected to a suitable driving device, for example an actuator or a motor, causing said peripheral movement of the fluid discharge body.

According to a fourth embodiment, the method comprises using, in step (A), a cutting tool and cut-forming means comprising a chemical cutting tool provided with at least one radially directed fluid discharge body for a chemically corrosive fluid, wherein the at least one fluid discharge body is in hydraulic communication with a fluid source for selective supply of the chemically corrosive fluid, and wherein said fluid discharge body is configured for cutting of the at least one peripherally extending hole through and past the wall of the pipe string, and within the longitudinal section, upon activating discharge of the chemically corrosive fluid in step (C);

wherein the chemical cutting tool also comprises at least one anchoring device structured for selective activation and being activated between step (B) and step (C) so as to anchor the chemical cutting tool in the pipe string before initiating step (C); and deactivating and releasing said anchoring device from the pipe string after step (C).

Chemical cutting tools provided with a radially directed fluid discharge body for a chemically corrosive fluid, the tools of which are to be used for cutting of pipes in a well, also constitute prior art per se, and particularly within the field of well technology. Typically, the chemically corrosive fluid is comprised of a suitable acid, whereas said fluid discharge body may comprise a nozzle of a suitable shape and material.

Further, the chemically corrosive fluid may be supplied to the cutting tool via a line from the surface. As an alternative, the chemical cutting tool may be provided with, or be associated with, an individual receptacle containing the chemically corrosive fluid and being connected to a suitable pumping means for allowing the fluid to be driven onto said radially directed fluid discharge body in the cutting tool.

Yet further, the chemical cutting tool may comprise at least one anchoring device and a potential centralizer device of the same type described in context of the above-mentioned perforation tool.

The at least one fluid discharge body may also be structured so as to be peripherally movable relative to the chemical cutting tool. Thereby, said fluid discharge body is movable in the peripheral direction during the cutting. This peripheral movement may possibly comprise an axial component of direction, thereby allowing an obliquely-directed peripheral hole to be cut through the pipe string, and along the circumference thereof, as viewed relative to the longitudinal axis of the pipe string. The fluid discharge body may also be structured in a manner allowing it to be moved back and forth in the peripheral cutting direction, thereby achieving a more precise and/or gentle cutting through the pipe string and said lines on the outside thereof. Thus, the fluid discharge body may be operatively connected to a suitable driving device, for example an actuator or a motor, causing said peripheral movement of the fluid discharge body.

Yet further, the fluid discharge body may comprise at least two separate chemical outlets directed toward a joint focal area at a radial distance from the fluid discharge body, wherein each chemical outlet is in hydraulic communication with a respective fluid source for selective supply of an individual chemical fluid, the at least two chemical fluids forming said chemically corrosive fluid upon mixing, and wherein said fluid discharge body is configured for cutting of the at least one peripherally extending hole through and past the wall of the pipe string, and within the longitudinal section, upon activating discharge, in step (C), of said chemical fluids from their respective chemical outlets and subsequent mixing of the fluids in said focal area.

In this context, each of the at least two chemical fluids may be supplied to the cutting tool via an individual fluid channel extending from the surface of the well, for example as individual fluid channels in a joint line. As an alternative, the chemical cutting tool may be provided with, or be associated with, individual receptacles containing, each, one of the at least two chemical fluids, the receptacles of which are connected to at least one pumping means for allowing the fluids to be driven onto said radially directed fluid discharge body in the cutting tool.

Such a mixing and focusing of individual fluid components into a chemically corrosive fluid constitute prior art per se, and particularly within the field of well technology.

According to a fifth embodiment, the method comprises using, in step (A), a cutting tool and cut-forming means comprising a plasma cutting tool provided with at least one radially directed plasma discharge body for charged plasma, wherein the at least one plasma discharge body is operatively connected to a plasma generator and an associated motive power source for generation and selective supply of plasma, and wherein said plasma discharge body is configured for cutting of the at least one peripherally extending hole through and past the wall of the pipe string, and within the longitudinal section, upon activating discharge of the plasma in step (C);

wherein the plasma cutting tool also comprises at least one anchoring device structured for selective activation and being activated between step (B) and step (C) so as to anchor the plasma cutting tool in the pipe string before initiating step (C); and deactivating and releasing said anchoring device from the pipe string after step (C).

The present applicant is not aware of any cutting tools that make use of, in a well, charged plasma for cutting of pipes, or for cutting of holes in a pipe string. Formation of such plasma assumes that sufficient voltage and electric energy must be provided to the location at which the plasma is to be used. Down within a well, such plasma must therefore be formed in situ at or in vicinity of the particular cutting place in the pipe string, and within a liquid-filled environment. In context of the present method, this implies that the plasma cutting tool, for generation of plasma, must be connected to a plasma generator, which in turn must be operatively connected to a suitable motive power source. Such a motive power source may comprise an electric power source and possibly a suitable voltage transformer for provision of sufficient voltage and electric energy to be able to generate charged plasma in situ down within the pipe string. This electric energy must also be transmitted onto the plasma generator.

As such, the plasma generator may be disposed in or on the plasma cutting tool.

Further, said motive power source for the plasma generator may be disposed in or on the plasma cutting tool.

As an alternative, said motive power source for the plasma generator may be disposed at a distance from the plasma generator, for example at a different location in the well or at the surface of the well. The motive power source and the plasma generator must also be operatively connected via a suitable energy transmission line, for example a cable.

The at least one plasma discharge body may also be structured so as to be peripherally movable relative to the plasma cutting tool. Thereby, said plasma discharge body is movable in the peripheral direction during the cutting. This peripheral movement may possibly comprise an axial component of direction, thereby allowing an obliquely-directed peripheral hole to be cut through the pipe string, and along the circumference thereof, as viewed relative to the longitudinal axis of the pipe string. The plasma discharge body may also be structured in a manner allowing it to be moved back and forth in the peripheral cutting direction, thereby achieving a more precise and/or gentle cutting through the pipe string and said lines on the outside thereof. Thus, the plasma discharge body may be operatively connected to a suitable driving device, for example an actuator or a motor, causing said peripheral movement of the plasma discharge body.

The preceding discussion has been concerned with various cutting tools capable of being used in step (A) of the present method.

The following discussion, however, will be concerned primarily with step (C) of the method, i.e. various ways of forming the at least one peripherally extending hole through and past the wall of the pipe string. This step may be carried out by means of any suitable cutting tool, for example one or more of the cutting tools described in the preceding embodiments.

According to a sixth embodiment, the method comprises cutting, in step (C), at least one helical or substantially helical hole in the axial direction along the pipe string, and within the longitudinal section, wherein the helical hole collectively covers, at least, the entire circumference of the pipe string.

According to a seventh embodiment, the method comprises cutting, in step (C), at least two separate and peripherally extending holes at an axial distance from each other within the longitudinal section, wherein each of the at least two peripheral holes covers an Individual circumferential sector of the entire circumference of the pipe string, and wherein said circumferential sectors collectively cover, at least, the entire circumference of the pipe string.

As one example of this seventh embodiment, two separate and peripherally extending holes may be cut at an axial distance from each other within the longitudinal section, wherein each of the two peripheral holes covers an Individual circumferential sector of the entire circumference of the pipe string, and wherein the two circumferential sectors collectively cover, at least, the entire circumference of the pipe string. For example, each of the two peripheral holes may cover an individual circumferential sector of at least ½ of the entire circumference of the pipe string.

As another example of this seventh embodiment, three separate and peripherally extending holes may be cut at an axial distance from each other within the longitudinal section, wherein each of the three peripheral holes covers an individual circumferential sector of the entire circumference of the pipe string, and wherein the three circumferential sectors collectively cover, at least, the entire circumference of the pipe string. For example, each of the three peripheral holes may cover an individual circumferential sector of at least ⅓ of the entire circumference of the pipe string.

As a further example of this seventh embodiment, four separate and peripherally extending holes may be cut at an axial distance from each other within the longitudinal section, wherein each of the four peripheral holes covers an individual circumferential sector of the entire circumference of the pipe string, and wherein the four circumferential sectors collectively cover, at least, the entire circumference of the pipe string. For example, each of the four peripheral holes may cover an Individual circumferential sector of at least ¼ of the entire circumference of the pipe string.

In a corresponding manner, any number of separate and peripherally extending holes may be cut at an axial distance from each other within the longitudinal section, wherein each of these peripheral holes covers an individual circumferential sector of the entire circumference of the pipe string, and wherein these circumferential sectors collectively cover, at least, the entire circumference of the pipe string.

Said at least two circumferential sectors may also overlap each other in the circumferential direction of the pipe string. This will ensure that the entire circumference of the pipe string is cut through by holes.

According to an eighth embodiment, the present method may also comprise, after cutting within said longitudinal section, displacing the cutting tool to at least one further longitudinal section of the well, and then repeating the cutting operation according to step (C) within the at least one further longitudinal section of the well. By so doing, such a cutting operation may be carried out in several longitudinal sections of the well, and during the same trip into the well.

According to a ninth embodiment, the present method may also comprise a subsequent step (D) of filling the pipe string, and also an annulus located immediately outside the pipe string and comprising the at least one severed line, with a fluidized plugging material within, at least, the longitudinal section of the well.

A suitable method for combined cleaning and plugging of such a longitudinal section of a well is described in NO 20111641 and in WO 2012/096580 A1. This method is marketed under the name HydraWash™.

Further, said fluidized plugging material may comprise cement slurry for formation of a cement plug. This constitutes the most common plugging material for plugging of one or more intervals in a well.

As a somewhat unusual alternative to cement slurry, the fluidized plugging material may comprise a fluidized particulate mass for formation of a plug of particulate mass. A somewhat different use of such a fluidized particulate mass in a well is described in WO 01/25594 A1 and in WO 02/081861 A.

According to a tenth embodiment, the method, in step (D), may also comprise the following sub-steps:

(D1) forming, within the longitudinal section, perforations (or holes) through the wall of the pipe string;

(D2) lowering a flow-through supply string into the pipe string until a lower portion of the supply string covers the longitudinal section, whereby an inner annulus exists between the supply string and the pipe string; and (D3) pumping the fluidized plugging material down through the supply string and up into the inner annulus so as to flow, therein, through said perforations (or holes) and further out into said annulus located outside the pipe string.

Step (D2) ensures that the fluidized plugging material is displaced efficiently up and out into said two annuli during the subsequent step (D3), and without being contaminated by other well fluids, for example a spacer fluid, potentially located within or near said longitudinal section of the well.

As one example of this tenth embodiment, the method may comprise, after sub-step (D3), a sub-step (D4) of pulling the supply string out of the well.

As another example of this tenth embodiment, said lower portion of the supply string may be comprised of a cementing pipe releasably connected to the remaining part of the supply string; and wherein the method also comprises the following:

in sub-step (D2), fixing the cementing pipe to the pipe string;

after sub-step (D3), releasing the cementing pipe from the remaining part of the supply string; and a sub-step (D4) of pulling the supply string out of the well.

SHORT DESCRIPTION OF THE FIGURES

Hereinafter, a non-limiting example of an embodiment of the present method is described.

FIGS. 1-12 show the following details:

FIG. 1 shows a front elevation, in section, of a portion of a petroleum well containing said longitudinal section to be plugged in accordance with prior art, wherein the figure shows various longitudinal lines disposed in an annulus between an outer casing string and an inner production tubing string in the well, and wherein FIG. 1 also shows a horizontal section line II-II;

FIG. 2 shows a plan view, in section, as viewed along section line II-II shown in FIG. 1, wherein FIG. 2 shows the lines in said annulus;

FIG. 3 shows a front elevation, in section, of the same portion of the well after having severed the production tubing string and said lines, and whilst being pulled out of the well;

FIG. 4 shows a front elevation, in section, of the longitudinal section of the well after having been filled, in a known manner, with cement slurry so as to form a cement plug in the well;

Figure 1:
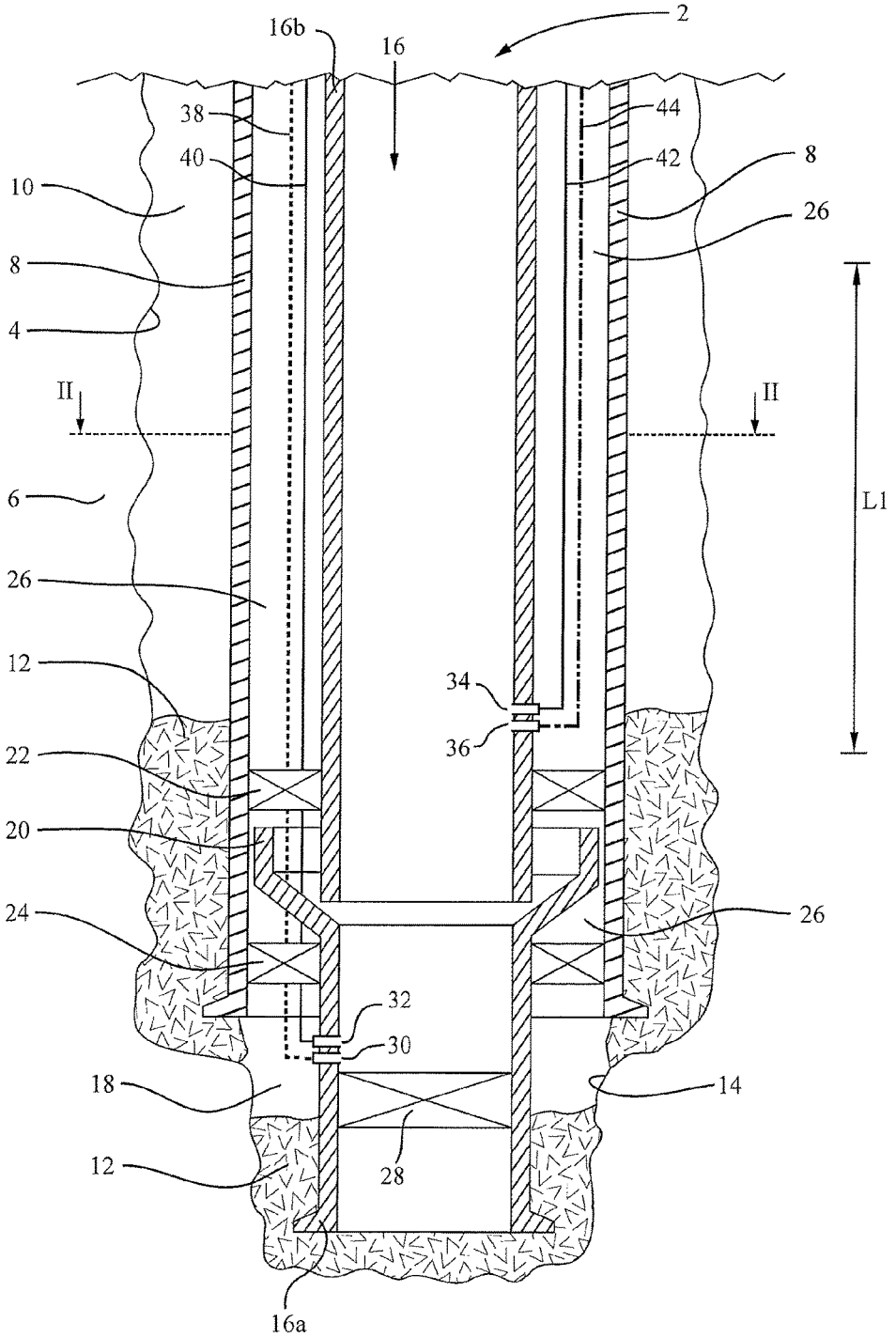
Fig. 1 PRIOR ART
FIGS. 1-4 show a portion of a petroleum well containing a longitudinal section to be plugged in accordance with prior art.
Figure 5:
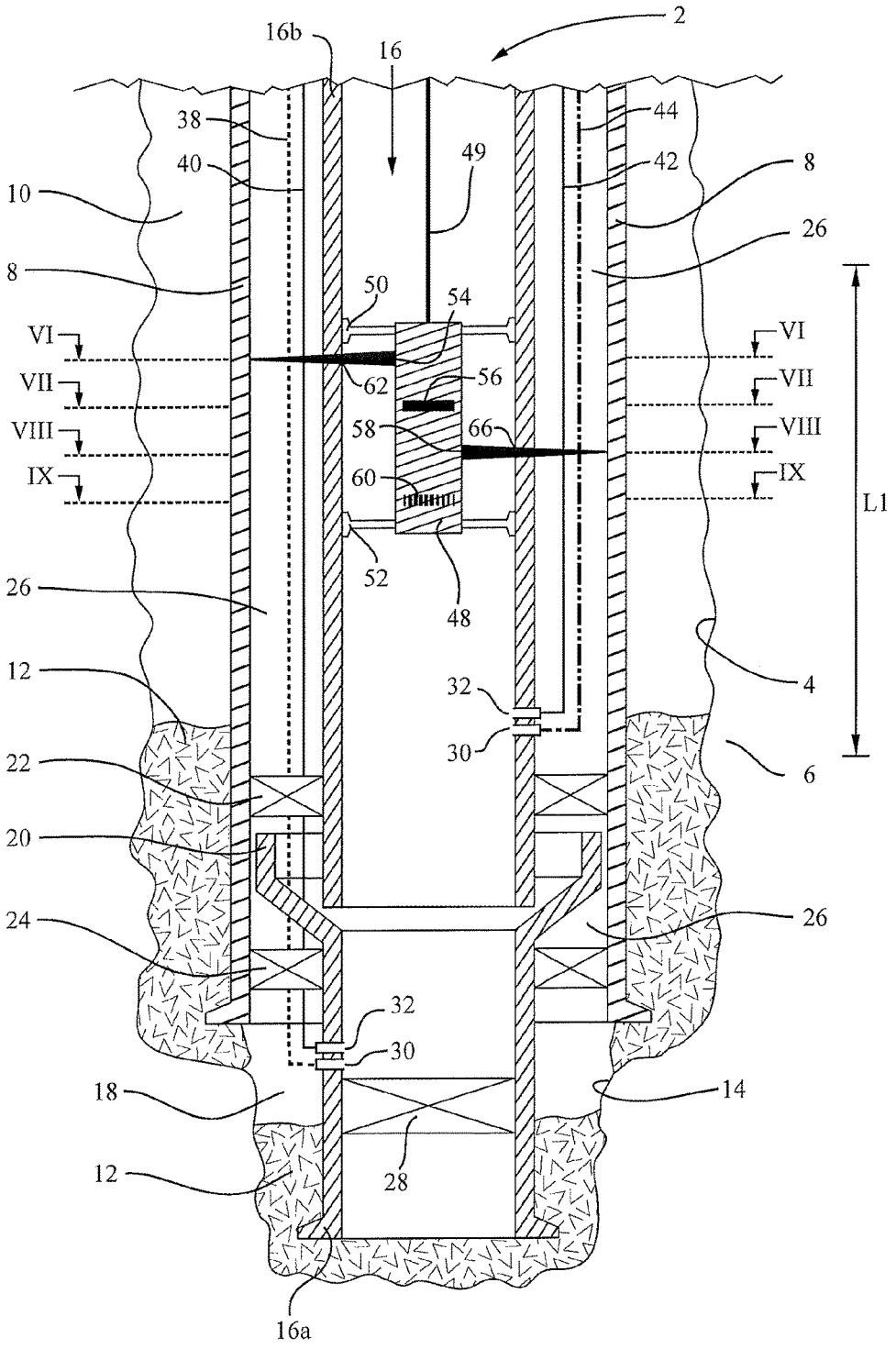
FIGS. 5-12 show the same portion and longitudinal section of the well shown in FIGS. 1-4, but wherein the plugging is to be carried out in an alternative manner, and without removing any pipes from the well, and by using the present method as an introductory step before initiating the plugging operation.
Figure 6:
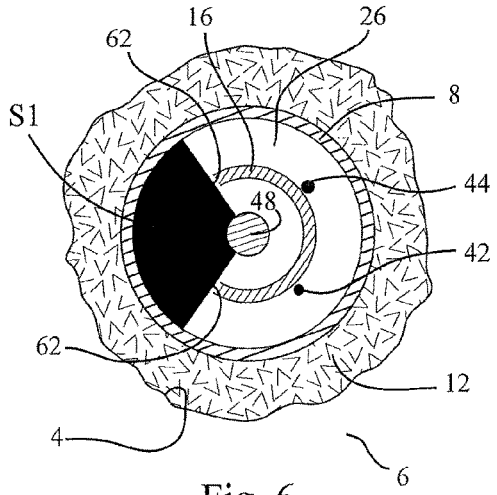
Figure 7:
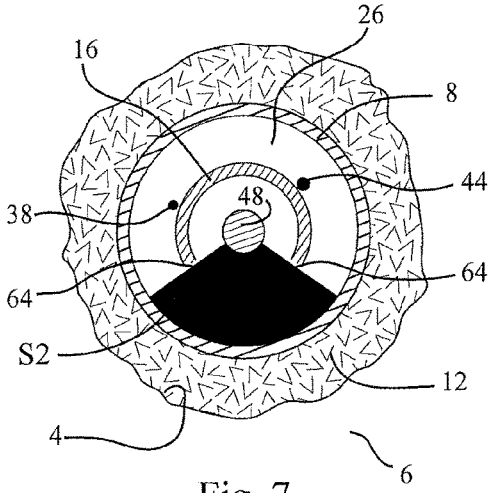
Figure 8:
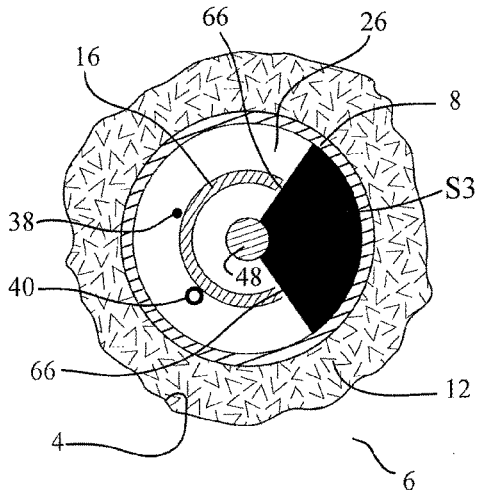
Figure 9:
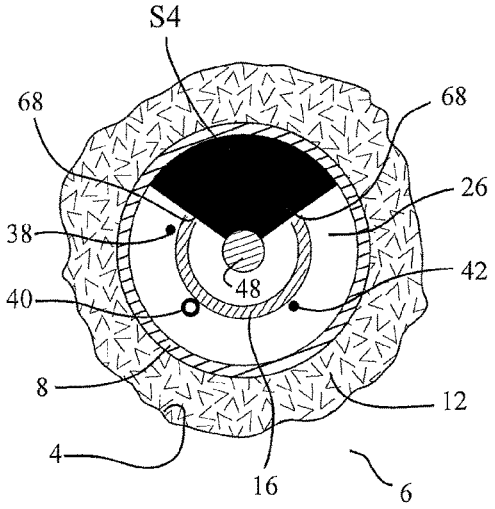
Figure 10:
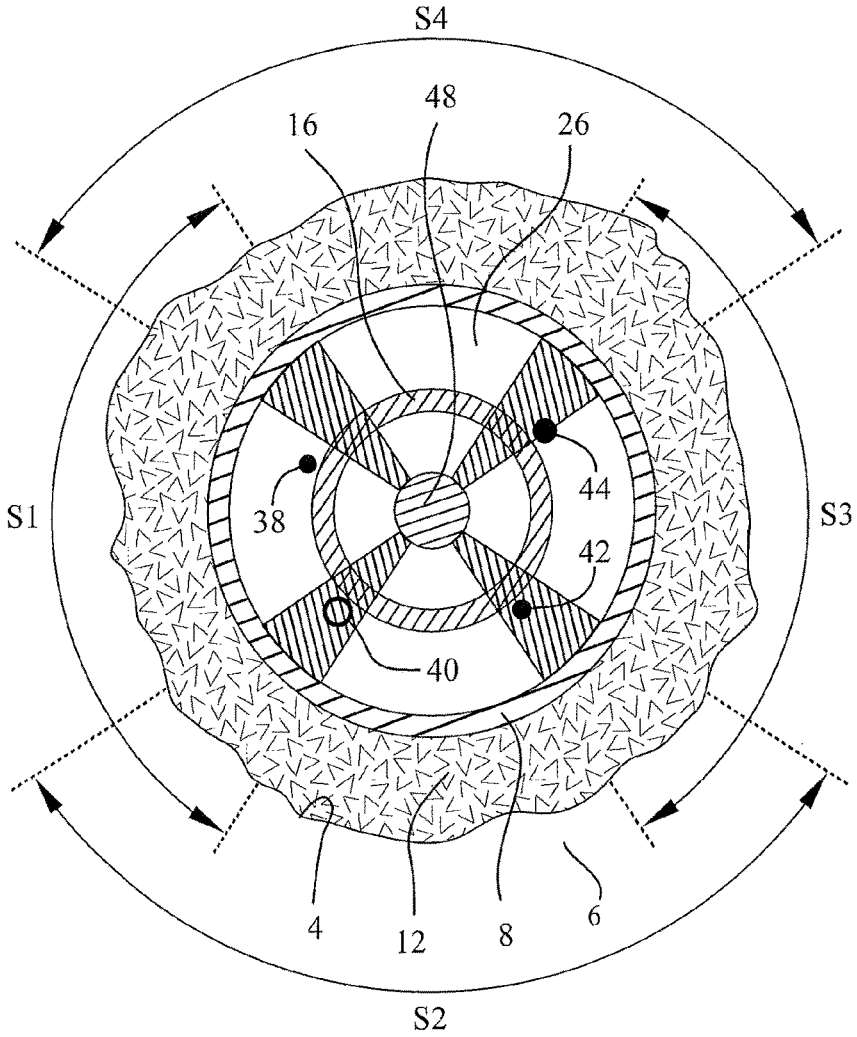
Figure 11:
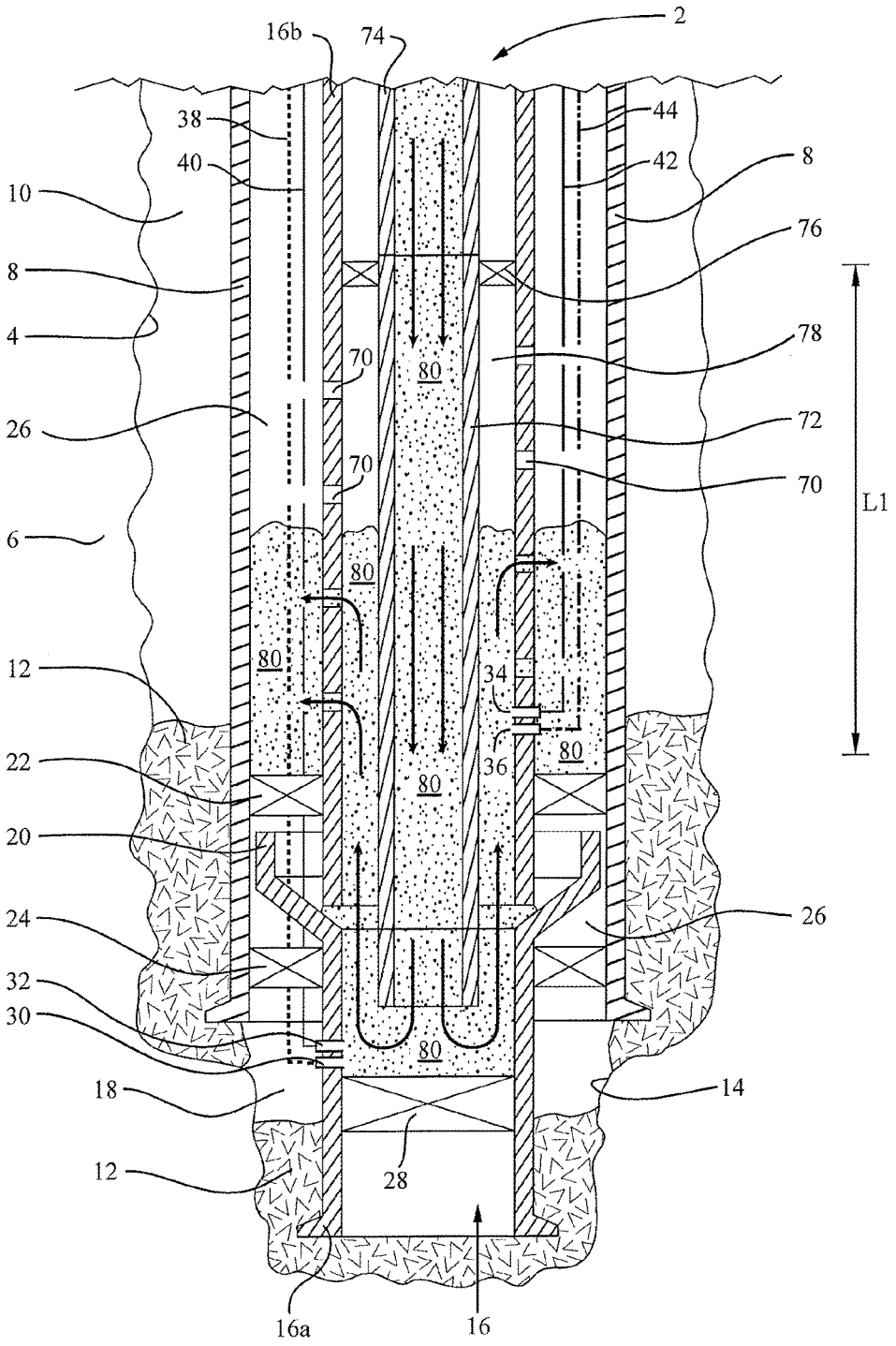
Figure 12:
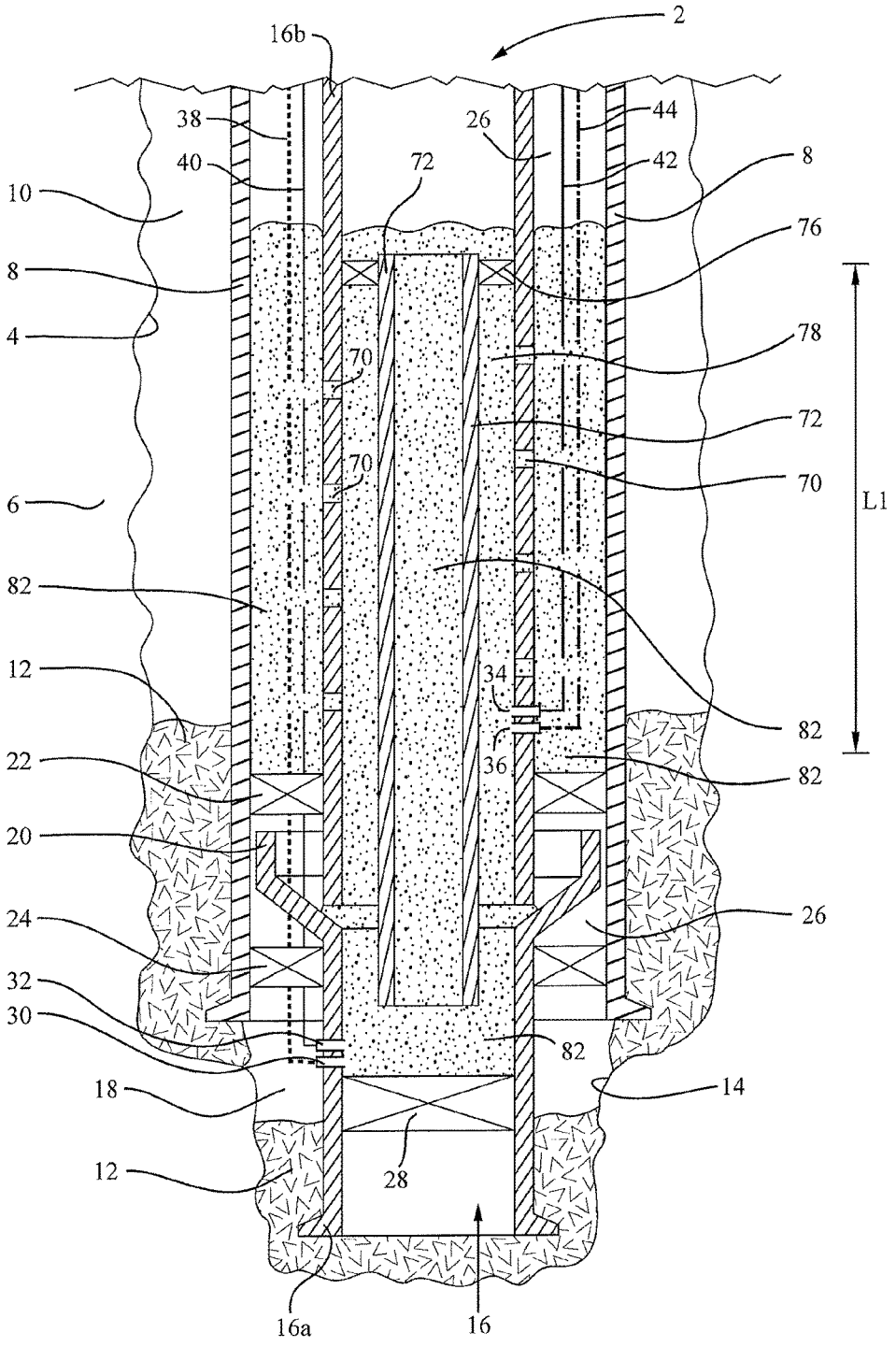

FIG. 5 shows a front elevation, in section, of the same portion of the petroleum well shown in FIG. 1, but wherein a cutting tool has been lowered into the production tubing string and is in the process of severing said lines in the annulus via holes in the production tubing string, and wherein the figure also shows horizontal section lines VI-VI, VII-VII, VIII-VIII and IX-IX at different depth levels along said longitudinal section;

FIGS. 6-9 show four plan views, in section, as viewed along the section lines VI-VI, VII-VII, VIII-VIII and IX-IX shown in FIG. 5, wherein each plan view shows a separate cut sector along which a peripheral hole is formed in a radial direction through and past the production tubing string, and along the circumference thereof, thereby also severing lines disposed within this circumferential sector;

FIG. 10 shows a composite plan view, in section, wherein said four separate cut sectors from FIGS. 6-9 are shown projected on top of each other in the axial direction in order to show the manner in which the cut sectors overlap each other, and wherein overlapping sector portions are shown with cross hachures;

FIG. 11 shows a front elevation, in section, of the same portion of the petroleum well shown in FIG. 5, but wherein the production tubing string now has been further perforated within said longitudinal section, wherein a short cementing pipe has been conducted into the production tubing string and along the longitudinal section, and wherein cement slurry is in the process of being filled into the production tubing string and into the annulus within the longitudinal section, and via said cementing pipe and perforations in the wall of the pipe string; and FIG. 12 shows a front elevation, in section, of said longitudinal section after having been filled with cement slurry so as to form a cement plug in the well, but without removing any pipes in the well.

The figures are schematic and merely show steps, details and equipment being essential to the understanding of the invention. Further, the figures are distorted with respect to relative dimensions of elements and details depicted in the figures. The figures are also somewhat simplified with respect to the shape and richness of detail of such elements and details. Hereinafter, equal, equivalent or corresponding details in the figures will be given substantially the same reference numerals.

DESCRIPTION OF THE EXEMPLARY EMBODIMENT

FIG. 1 shows a portion of a typical petroleum well 2 containing a longitudinal section L1 to be plugged in accordance with prior art. The well 2 has been formed in a known manner by drilling a first borehole 4 through a subterranean formation 6, after which a casing string 8 has been lowered into the borehole 4 to be fixed therein by circulating cement slurry into an annulus 10 located between the formation 6 and the casing string 8. Subsequently, the cement slurry has hardened into cement 12 in the annulus 10.

A second borehole 14, which has a smaller diameter than the first borehole 4, has then been drilled further down into the subterranean formation 6 and through one or more petroleum reservoirs (not shown), whereupon a production tubing string 16 has been conducted into the casing string 8 and further down into the second borehole 14. The production tubing string 16 has been fixed in the well 2 by circulating cement slurry into an annulus 18 located between the formation 6 and the production tubing string 16. The cement slurry has then hardened into cement 12 in the annulus 18; this being similar to the cementation in the annulus 10 in the preceding well section. Then, the well 2 has been completed and put into production.

The production tubing string 16 comprises, in a known manner, a lower liner 16*a* extending into the second borehole 14, and an upper connection pipe 16*b* extending upward through the casing string 8 and onward to the surface of the well 2. Further, and in a known manner, a lower end of the connection pipe 16*b* has been conducted pressure-sealingly into, and is axially movable within, a so-called polished bore receptacle 20 at an upper end of the liner 16*a*. This polished bore receptacle connection is located at the bottom of the first borehole 4 and is defined axially by an upper annulus packer 22 and a lower annulus packer 24, both of which are disposed pressure-sealingly in an annulus 26 located between the outer casing string 8 and the inner production tubing string 16 (see FIG. 1). Moreover, a mechanical plug 28 has been set in an upper portion of the lower liner 16*a* so as to form an upper pressure barrier in the liner 16*a*, but also to form a base for a cement plug to be formed in the subsequent plugging operation.

The production tubing string 16 is also provided with various downhole equipment 30, 32, 34, 36, for example pressure- and temperature sensors, various actuators and motors, valves, chemical nozzles, etc., all of which are operatively connected to respective lines 38, 40, 42, 44 extending to the surface of the well via the annulus 26 and along the production tubing string 16. In this well configuration, and for the purpose of illustration, lines 38, 42, 44 are comprised of signal-transmitting cables, whereas line 40 is comprised of a thin hydraulic pipe. The cables 42 and 44 are disposed above the upper annulus packer 22 and are connected to the respective downhole equipment 34, 36. However, and via pressure-tight connectors of a suitable type (not shown), the cable 38 and the hydraulic pipe 40 are conducted further downward and past both annulus packers 22, 24 and the polished bore receptacle 20 where they are connected to the respective downhole equipment 30, 32 disposed below the lower annulus packer 24. All lines 38, 40, 42, 44 are fixed on the outside of the production tubing string 16 and are distributed along the circumference thereof, as shown best in FIG. 2. Such lines may also comprise various other types of lines, for example chemical injection pipes, control signal cables, power supply cables, data communication lines, etc. Furthermore, the lines 38, 40, 42, 44 may have a different circumferential distribution along the pipe string 16 than the circumferential distribution shown in the well cross section depicted by FIG. 2.

Figure 3:
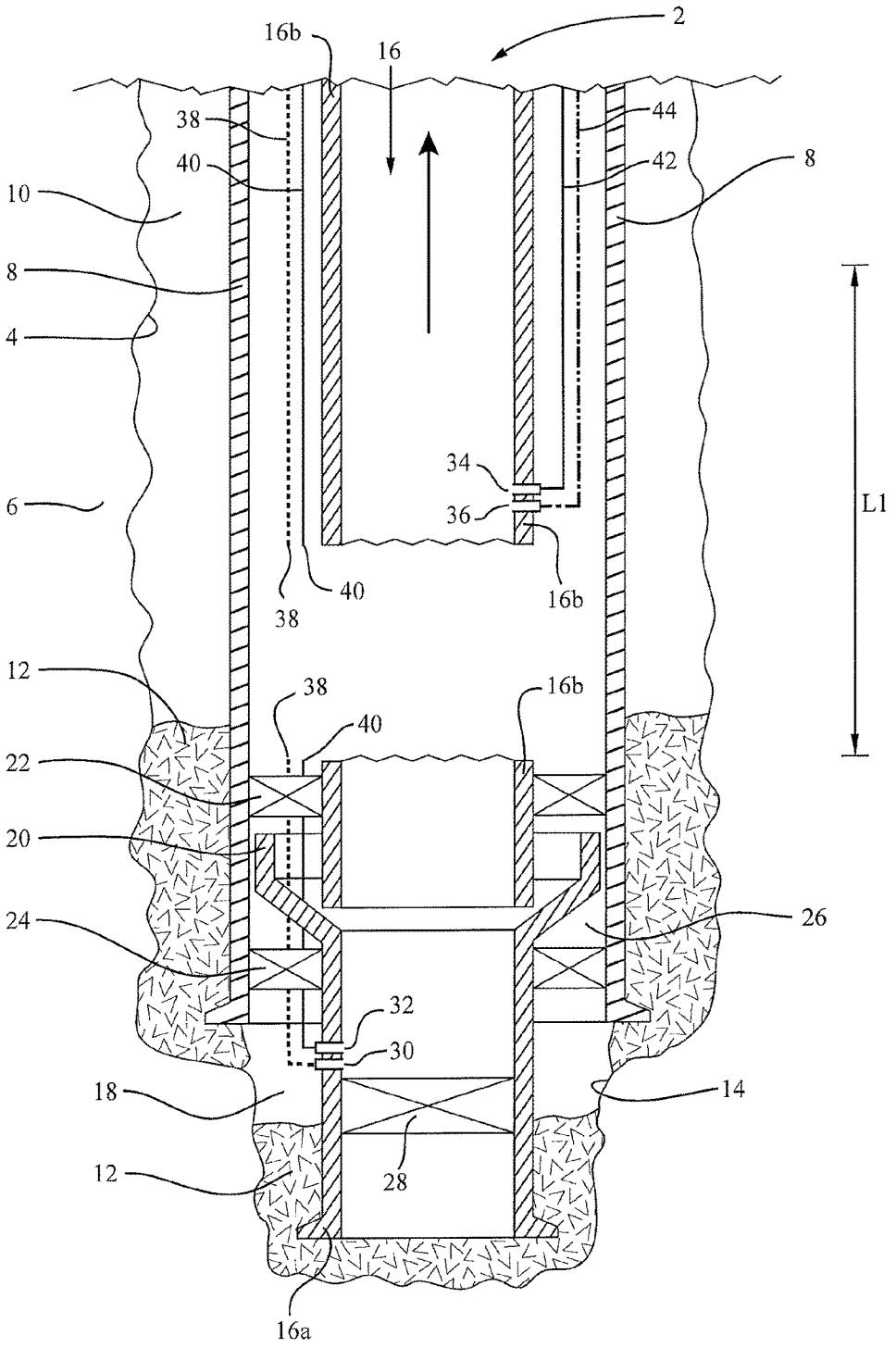
Fig. 3 PRIOR ART

FIG. 3 shows the production tubing string 16 and the lines 38, 40, 42, 44 after being severed, in a known manner, and in the process of being pulled out of the well 2, which is indicated with an arrow in the figure. In this case, the upper connection pipe 16*b* has been severed immediately above the polished bore receptacle 20 and the upper annulus packer 22.

Figure 4:
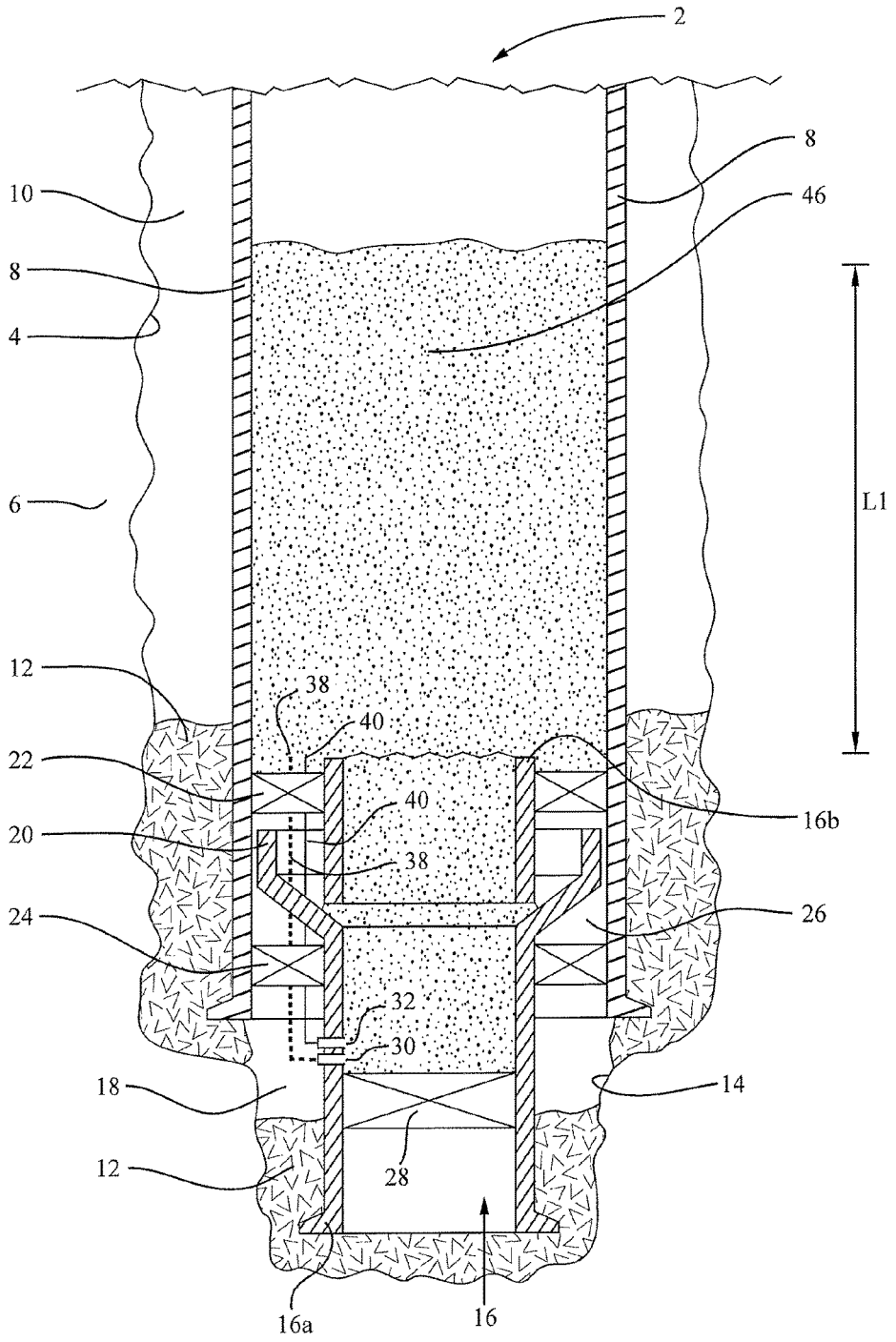
Fig. 4 PRIOR ART

FIG. 4 shows the well 2 after having pulled the severed production tubing string 16 with severed lines 38, 40, 42, 44 out of the well 2, and after having filled the longitudinal section L1 of the well and a remaining upper end portion of the production tubing string 16, the end portion of which is located above the mechanical plug 28, with cement slurry which then has hardended into a cement plug 46 in the well 2.

Reference is now made to FIGS. 5-11, which show the same portion of the well 2 shown in FIGS. 1-4, wherein the same longitudinal section L1 now is to be plugged in an alternative manner, but without removing any pipes 8, 16 from the well 2. In this context, the present method is used as an introductory step before initiating the very plugging operation.

Figure 2:
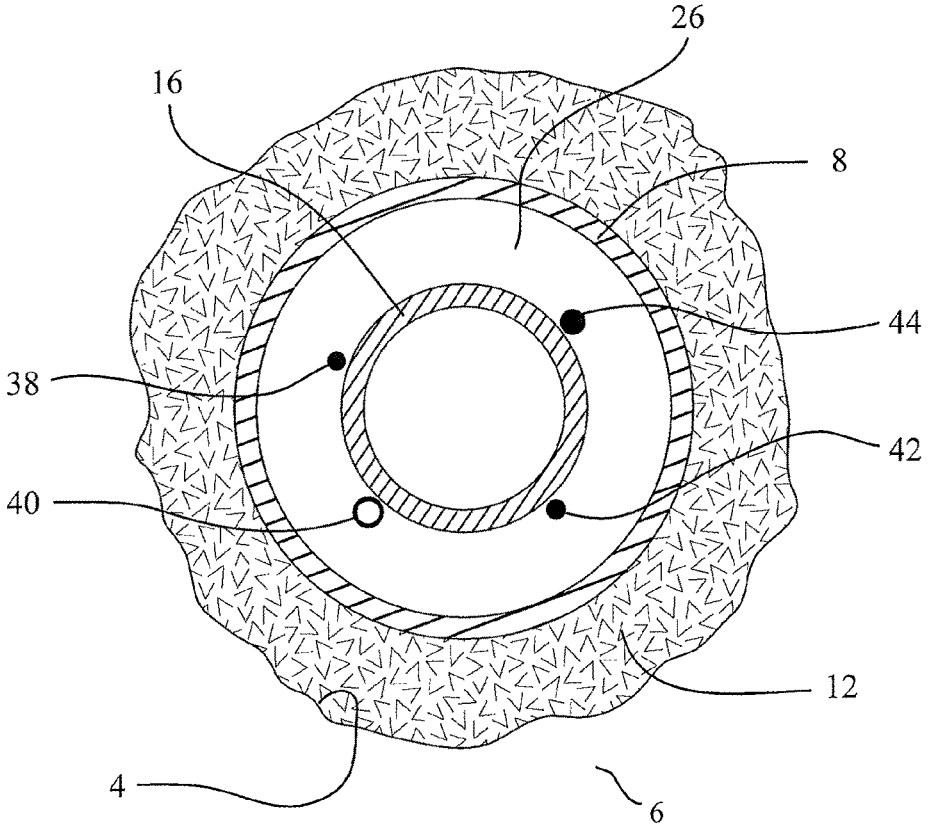
Fig. 2 PRIOR ART

FIG. 5 shows the same well configuration as that of FIGS. 1 and 2, but now the figure shows a cutting tool 48 having been lowered into the production tubing string 16 on a suitable connection line 49, and to a position within said longitudinal section L1. The connection line 49 is merely shown schematically and may comprise an electric cable, a coiled tubing string or a drill pipe string, depending on the type of cutting tool 48 being used. Further, the cutting tool 48 is shown anchored to the wall of the pipe string 16 by means of two releasable anchoring devices, i.e. a respective upper anchoring device 50 and a lower anchoring device 52, the devices of which are disposed at an upper end and a lower end, respectively, of the cutting tool 48. Each anchoring device 50, 52 is merely shown schematically and may comprise one or more radially expandable gripping devices (not shown), for example gripping dogs, being activated and expanded outward, when required, until engagement with the wall of the pipe string 16, and being deactivated and released from the pipe string 16 upon having completed the cutting operation. However, such anchoring devices are not always necessary, for example when using explosives in some well configurations.

The cutting tool 48 may be comprised of any suitable cutting tool, for example a perforation tool provided with explosive charges, a hydraulic cutting tool, a mechanical cutting tool, a chemical cutting tool or a plasma cutting tool (cf. the preceding discussion on such cutting tools). In this embodiment, the cutting tool 48 comprises a total of four cut-forming means 54, 56, 58, 60 configured for controlled cutting, upon activation, in a radial direction outward from the cutting tool 48, and in a peripheral direction relative to the cutting tool 48. The type of cut-forming means being used depends on the type of cutting tool being used in the particular case, as described above.

In this embodiment, the four cut-forming means 54, 56, 58, 60 are distributed at an equal axial distance along the cutting tool 48, as shown in FIG. 5. Moreover, each cut-forming means 54, 56, 58, 60 is directed toward a respective and Individual circumferential sector S1, S2, S3 and S4 of the entire circumference of the production tubing string 16, as shown in FIGS. 6-9. In this embodiment, each circumferential sector S1, S2, S3, S4 covers a little more than ¼ of the entire circumference of the pipe string 16, for example a circumferential sector having a 100° sector angle of a 360° circumferential surface. The circumferential sectors S1, S2, S3, S4 overlap each other in the circumferential direction of the pipe string 16 when projected on top of each other in the axial direction, the respective and overlapping sector fields being shown with cross hachures in FIG. 10. Collectively, the four circumferential sectors S1, S2, S3, S4 cover at least the entire circumference of the pipe string 16.

FIG. 5 as well as FIGS. 6-9 also show the cutting tool 48 whilst each cut-forming means 54, 56, 58, 60 is in the process of cutting a respective radially and peripherally extending hole (or slit) 62, 64, 66, 68 through and past the wall of the pipe string 16, and along each respective circumferential sector S1, S2, S3, S4 of the circumference of the pipe string 16. This ensures that all lines 38, 40, 42, 44 are severed during the cutting operation, and even if the lines 38, 40, 42, 44 should have a different distribution along the circumference of the pipe string 16. FIGS. 5-9 also show the respective cutting path and circumferential sector S1, S2, S3, S4 for each cut-forming means 54, 56, 58, 60. We also mention, in this context, that each cut-forming means 54, 56, 58, 60 may be structured so as to be static relative to the cutting tool 48, whereby each respective hole 62, 64, 66, 68 is cut in a single operation. Alternatively, each cut-forming means 54, 56, 58, 60 may be structured so as to be peripherally movable relative to the cutting tool 48, and possibly back and forth in the peripheral cutting direction, whereby each respective hole 62, 64, 66, 68 is cut in response to a peripheral movement of each cut-forming means 54, 56, 58, 60 (cf. discussion on this above). For such peripheral movement, the cutting tool 48 may be structured in such a manner that the cut-forming means 54, 56, 58, 60 are moved synchronously, or the cutting tool 48 may be structured in such a manner that the cut-forming means 54, 56, 58, 60 are moved individually and independently of each other. Said cutting operation ensures that the lines 38, 40, 42, 44, which are located on the outside of the pipe string 16, are severed within the longitudinal section L1, and without simultaneously severing the pipe string 16.

Upon having cut said peripherally extending holes 62, 64, 66, 68 through the wall of the pipe string 16, the cutting tool 48 may possibly be moved axially to a new cutting portion within the longitudinal section L1 where said cutting procedure is repeated (not shown in the figures). By so doing, further peripherally extending holes may be cut through and past the wall of the pipe string 16. Before initiating the cutting at the new cutting portion, the cutting tool 48 and/or the cut-forming means 54, 56, 58, 60 may possibly be rotated in the peripheral direction, whereby each respective circumferential sector S1, S2, S3, S4 is also rotated in the peripheral direction. By so doing, also the new peripherally extending holes (or slits) at the new cutting portion will be displaced somewhat in the peripheral direction relative to the preceding holes 62, 64, 66, 68 within the longitudinal section L1. This provides further ensurance that the lines 38, 40, 42, 44 are cut at least at one place within the longitudinal section L1.

FIG. 11 shows the production tubing string 16 after further perforations 70 have been formed, in a known manner, through the wall of the pipe string 16, and within the longitudinal section L1. A short cementing pipe 72, which constitutes a lower portion of a supply string, here in the form of a drill pipe string 74, the cementing pipe of which is releasably connected to the drill pipe string 74, has then been conducted into the pipe string 16 until the cementing pipe 72 covers the longitudinal section L1. An annulus packer 76 is also disposed in a pressure-sealing manner around an upper end of the cementing pipe 72, and within an inner annulus 78 located between the production tubing string 16 and the cementing pipe 72. By so doing, cement slurry 80 may be pumped down through the drill pipe string 74 and the cementing pipe 72 so as to gradually fill the production tubing string 16 and the inner annulus 78. During the filling, and simultaneously, the cement slurry 80 is forced out through said perforations 70 and flows further out into the surrounding outer annulus 26 and around the severed lines 38, 40, 42, 44 located therein, as shown in FIG. 11. This course of flow, which is shown with downstream-directed arrows in FIG. 11, continues until a desired volume of said cement slurry 80 is filled into the production tubing string 16 and into said annuli 78 and 26. This course of flow also ensures that the cement slurry 80 is displaced efficiently up and out into said two annuli 78, 26 during the pumping of cement slurry 80, and without being contaminated by, for example, a spacer fluid (not shown) that may be located within or near the longitudinal section L1.

FIG. 12 shows said portion and longitudinal section L1 of the petroleum well 2 after the cement slurry 80 has hardened into a cement plug 82 in the well 2, and after said drill pipe string 74 has been released from the cementing pipe 72 and has been pulled out of the well 2. In this manner, it is possible to plug the longitudinal section L1 of the well 2, including the severed lines 38, 40, 42, 44 in the annulus 26, without removing parts of the production tubing string 16. At the same time, the pipe string 16 is used as reinforcement for the cement plug 82, whereby the integrity of the well 2, in terms of strength, is not significantly weakened within the longitudinal section L1. By so doing, the objects of the invention are also fulfilled.

The invention claimed is:

1. A method for downhole cutting of at least one line disposed outside and along a pipe string in a well, and without simultaneously severing the pipe string, wherein the method comprises:

(A) using, for said downhole cutting, a cutting tool structured for selective cutting activation and provided with at least one cut-forming means configured for cutting, upon said activation, in a radial direction outward from the cutting tool, wherein the cutting tool also is configured for controlled cutting, by said cut-forming means, in a peripheral direction and distributed in an axial direction relative to the cutting tool;

(B) lowering, on a connection line, the cutting tool into the pipe string to a longitudinal section of the well where the cutting of the at least one line is to be carried out; and (C) activating, within said longitudinal section, the cutting tool and cutting, in the radial direction through and past the wall of the pipe string, at least one peripherally extending hole collectively covering, at least, the entire circumference of the pipe string, and also distributing the at least one peripherally extending hole in the axial direction along the pipe string, thereby ensuring that the at least one line, which is located on the outside of the pipe string, also is severed within the longitudinal section, and without simultaneously severing the pipe string.

2. The method according to claim 1, wherein the cutting tool and cut-forming means comprise a perforation tool provided with at least one explosive charge configured for cutting of the at least one peripherally extending hole through and past the wall of the pipe string, and within the longitudinal section, upon activating detonation in (C).

3. The method according to claim 2, wherein the perforation tool also comprises at least one anchoring device structured for selective activation and being activated between (B) and (C) so as to anchor the perforation tool in the pipe string before initiating (C); and deactivating and releasing said anchoring device from the pipe string after (C).

4. The method according to claim 1, wherein the cutting tool and cut-forming means comprise a hydraulic cutting tool provided with at least one radially directed fluid discharge body for an abrasive fluid, wherein the at least one fluid discharge body is in hydraulic communication with a fluid source for selective supply of the abrasive fluid, and wherein said fluid discharge body is configured for cutting of the at least one peripherally extending hole through and past the wall of the pipe string, and within the longitudinal section, upon activating discharge of the abrasive fluid in (C);

wherein the hydraulic cutting tool also comprises at least one anchoring device structured for selective activation and being activated between (B) and (C) so as to anchor the hydraulic cutting tool in the pipe string before initiating (C); and deactivating and releasing said anchoring device from the pipe string after (C).

5. The method according to claim 4, wherein the at least one fluid discharge body is structured so as to be peripherally movable relative to the hydraulic cutting tool, whereby said fluid discharge body is movable in the peripheral direction during the cutting.

6. The method according to claim 1, wherein the cutting tool and cut-forming means comprise a mechanical cutting tool provided with at least one radially movable cutting body, wherein the at least one cutting body is connected to a motive power source for selective supply of motive power to said cutting body, and wherein said cutting body is configured for cutting of the at least one peripherally extending hole through and past the wall of the pipe string, and within the longitudinal section, upon activating supply of motive power in (C);

wherein the mechanical cutting tool also comprises at least one anchoring device structured for selective activation and being activated between (B) and (C) so as to anchor the mechanical cutting tool in the pipe string before initiating (C); and deactivating and releasing said anchoring device from the pipe string after (C).

7. The method according to claim 6, wherein the at least one cutting body also is structured so as to be peripherally movable relative to the mechanical cutting tool, whereby said cutting body is movable in the peripheral direction during the cutting.

8. The method according to claim 1, wherein the cutting tool and cut-forming means comprise a chemical cutting tool provided with at least one radially directed fluid discharge body for a chemically corrosive fluid, wherein the at least one fluid discharge body is in hydraulic communication with a fluid source for selective supply of the chemically corrosive fluid, and wherein said fluid discharge body is configured for cutting of the at least one peripherally extending hole through and past the wall of the pipe string, and within the longitudinal section, upon activating discharge of the chemically corrosive fluid in (C);

wherein the chemical cutting tool also comprises at least one anchoring device structured for selective activation and being activated between (B) and (C) so as to anchor the chemical cutting tool in the pipe string before initiating (C); and deactivating and releasing said anchoring device from the pipe string after (C).

9. The method according to claim 8, wherein the at least one fluid discharge body also is structured so as to be peripherally movable relative to the chemical cutting tool, whereby said fluid discharge body is movable in the peripheral direction during the cutting.

10. The method according to claim 8, wherein the fluid discharge body comprises at least two separate chemical outlets directed toward a joint focal area at a radial distance from the fluid discharge body, wherein each chemical outlet is in hydraulic communication with a respective fluid source for selective supply of an individual chemical fluid, the at least two chemical fluids forming said chemically corrosive fluid upon mixing, and wherein said fluid discharge body is configured for cutting of the at least one peripherally extending hole through and past the wall of the pipe string, and within the longitudinal section, upon activating discharge, in (C), of said chemical fluids from their respective chemical outlets and subsequent mixing of the fluids in said focal area.

11. The method according to claim 1, wherein the cutting tool and cut-forming means comprise a plasma cutting tool provided with at least one radially directed plasma discharge body for charged plasma, wherein the at least one plasma discharge body is operatively connected to a plasma generator and an associated motive power source for generation and selective supply of plasma, and wherein said plasma discharge body is configured for cutting of the at least one peripherally extending hole through and past the wall of the pipe string, and within the longitudinal section, upon activating discharge of the plasma in (C);

wherein the plasma cutting tool also comprises at least one anchoring device structured for selective activation and being activated between (B) and (C) so as to anchor the plasma cutting tool in the pipe string before initiating (C); and deactivating and releasing said anchoring device from the pipe string after (C).

12. The method according to claim 11, wherein the plasma generator is disposed in or on the plasma cutting tool.

13. The method according to claim 11, wherein said motive power source for the plasma generator is disposed in or on the plasma cutting tool.

14. The method according to claim 11, wherein said motive power source for the plasma generator is disposed at a distance from the plasma generator.

15. The method according to claim 11, wherein the at least one plasma discharge body also is structured so as to be peripherally movable relative to the plasma cutting tool, whereby said plasma discharge body is movable in the peripheral direction during the cutting.

16. The method according to claim 1, further comprising cutting, in (C), at least one helical hole in the axial direction along the pipe string, and within the longitudinal section, wherein the helical hole collectively covers, at least, the entire circumference of the pipe string.

17. The method according to claim 1, further comprising cutting, in (C), at least two separate and peripherally extending holes at an axial distance from each other within the longitudinal section, wherein each of the at least two peripheral holes covers a respective individual circumferential sector of the entire circumference of the pipe string, and wherein said circumferential sectors collectively cover, at least, the entire circumference of the pipe string.

18. The method according to claim 17, further comprising cutting two separate and peripherally extending holes at an axial distance from each other within the longitudinal section, wherein each of the two peripheral holes covers the respective individual circumferential sector of the entire circumference of the pipe string, and wherein the two circumferential sectors collectively cover, at least, the entire circumference of the pipe string.

19. The method according to claim 18, wherein the respective individual circumferential sector of each of the two peripheral holes covers at least ½ of the entire circumference of the pipe string.

20. The method according to claim 17, further comprising cutting three separate and peripherally extending holes at an axial distance from each other within the longitudinal section, wherein each of the three peripheral holes covers the respective individual circumferential sector of the entire circumference of the pipe string, and wherein the three circumferential sectors collectively cover, at least, the entire circumference of the pipe string.

21. The method according to claim 20 wherein the respective individual circumferential sector of each of the three peripheral holes covers at least ⅓ of the entire circumference of the pipe string.

22. The method according to claim 17, further comprising cutting four separate and peripherally extending holes at an axial distance from each other within the longitudinal section, wherein each of the four peripheral holes covers the respective individual circumferential sector of the entire circumference of the pipe string, and wherein the four circumferential sectors collectively cover, at least, the entire circumference of the pipe string.

23. The method according to claim 22, wherein the respective individual circumferential sector of each of the four peripheral holes covers at least ¼ of the entire circumference of the pipe string.

24. The method according to claim 17, wherein the circumferential sectors overlap each other in the circumferential direction of the pipe string.

25. The method according to claim 1, wherein the method, after cutting within the longitudinal section, also comprises displacing the cutting tool to at least one further longitudinal section of the well, and then repeating the cutting operation according to (C) within the at least one further longitudinal section of the well.

26. The method according to claim 1, wherein the method also comprises a subsequent (D) of filling the pipe string, and also an annulus located immediately outside the pipe string and comprising the at least one severed line, with a fluidized plugging material within, at least, the longitudinal section of the well.

27. The method according to claim 26, wherein the fluidized plugging material comprises cement slurry for formation of a cement plug.

28. The method according to claim 26, wherein the fluidized plugging material comprises a fluidized particulate mass for formation of a plug of particulate mass.

29. The method according to claim 26, wherein the method, in (D), comprises the following:

(D1) forming, within the longitudinal section, perforations through the wall of the pipe string;

(D2) lowering a flow-through supply string into the pipe string until a lower portion of the supply string covers the longitudinal section, whereby an inner annulus exists between the supply string and the pipe string; and (D3) pumping the fluidized plugging material down through the supply string and up into the inner annulus so as to flow, therein, through said perforations and further out into said annulus located outside the pipe string.

30. The method according to claim 29, wherein the method, after (D3), comprises a (D4) of pulling the supply string out of the well.

31. The method according to claim 29, wherein said lower portion of the supply string is comprised of a cementing pipe releasably connected to the remaining part of the supply string; and wherein the method also comprises the following:

in (D2), fixing the cementing pipe to the pipe string;

after (D3), releasing the cementing pipe from the remaining part of the supply string; and a (D4) of pulling the supply string out of the well.

* * * * *